United States Patent [19]

Lipowitz et al.

[11] 4,207,071

[45] Jun. 10, 1980

[54] DURABLE MODIFICATION OF FIBROUS SUBSTRATES USING A POLYOXYETHYLENE-CONTAINING SILANE AND ARTICLES THEREFROM

[75] Inventors: Jonathan Lipowitz, Midland; Robert E. Kalinowski, Auburn, both of Mich.

[73] Assignee: Dow Corning Corporation, Midland, Mich.

[21] Appl. No.: 8,654

[22] Filed: Feb. 1, 1979

[51] Int. Cl.[2] ..... D06M 15/66; D06M 15/68

[52] U.S. Cl. ..... 8/115.6; 8/116 R; 427/387; 428/245; 428/266; 428/290; 428/391; 428/395; 428/419; 428/447; 428/480

[58] Field of Search ..... 428/391, 395, 447, 419, 428/266, 290, 245, 480; 427/387; 8/115.6, 116 R

[56] References Cited

U.S. PATENT DOCUMENTS

| | | | |
|---|---|---|---|
| 3,140,198 | 7/1964 | Dawson | 428/391 |
| 3,364,059 | 11/1968 | Marzocchi | 428/391 |
| 3,639,156 | 2/1972 | Pittman | 428/447 |
| 4,062,693 | 12/1977 | Berger | 106/288 Q |
| 4,110,227 | 8/1978 | Newkirk | 428/395 |

FOREIGN PATENT DOCUMENTS

| | | | |
|---|---|---|---|
| 703563 | 2/1965 | Canada | 428/447 |
| 804369 | 11/1958 | United Kingdom | 428/447 |
| 880022 | 10/1961 | United Kingdom | 428/447 |

*Primary Examiner*—Ellis P. Robinson
*Attorney, Agent, or Firm*—George A. Grindahl

[57] ABSTRACT

Fibrous substrates are durably modified by applying a polyoxyethylene-containing silane to the substrate and heating the substrate to cure the silane. Durability of the treatment is achieved by using a silane having the formula $R(OCH_2CH_2)_xOR'SR''SiZ_3$ where Z denotes a hydroxyl or a hydrolyzable radical, R' and R'' are divalent aliphatic radicals of suitable size, R is hydrogen, lower alkyl or lower acyl and x has a value of at least 3. The silane is applied to the fibrous substrate, such as a hydrophobic fabric, as a homogeneous liquid composition comprising the silane, a volatile liquid carrier and a siloxane polymerization catalyst to provide a treated substrate having improved properties, such as hydrophilicity.

8 Claims, No Drawings

DURABLE MODIFICATION OF FIBROUS SUBSTRATES USING A POLYOXYETHYLENE-CONTAINING SILANE AND ARTICLES THEREFROM

BACKGROUND OF THE INVENTION

This invention relates to a process for durably modifying a fibrous substrate with a polyoxyethylene-containing silane and to a modified fibrous substrate obtained therefrom.

Many fibrous substrates possess some degree of hydrophobicity because they comprise a hydrophobic fiber and/or because they bear hydrophobic surface-modifying agents such as sizes, dyes, crease-resistant resins, softening agents, flame retardants and binders. While being desirable in some fibrous substrates, hydrophobicity in others, such as textiles, other than in rainwear, is undesirable and is believed to be responsible for such well-known problems as the lack of "cotton-comfort" and poor oil-borne soil-release during laundering of the textile.

It is known that the hydrophilicity and soil-release properties of synthetic fabrics may be improved by applying hydrophilic polymers thereto. In particular, Pittman et al., U.S. Pat. No. 3,639,156, teaches that a fibrous substrate may be modified with a siloxane homopolymer which contains recurring units of the structure $YO(Alk\text{-}O)_bXSiG_cO_d/2$, such as $CH_3O(CH_2CH_2O)_{12}CH_2CH_2CH_2SiO_{3/2}$.

However, when one treats a textile with an aqueous solution of hydrolyzed $$CH_3\overset{O}{\overset{\|}{C}}(OCH_2CH_2)_{12}OCH_2CH_2CH_2Si(OCH_3)_3$$

and heats the treated textile to cure the siloxane, the resulting treatment is not durable to laundering. It is thought that this non-durability to laundering is due to the known reluctance of the polyoxyethylene-substituted silane precursor to adequately condense, i.e. cure, to a siloxane structure when there is more than three oxyethylene units in the polyoxyethylene substituent and said substituent is bonded to silicon through a propyleneoxy group, as demonstrated by Birchall, et al., Nature, Vol. 266, p. 154 (10 March 1977).

SUMMARY OF THE INVENTION

It is thus an object of the present invention to provide a process for durably modifying a fibrous substrate with a polyoxyethylene-containing organosilicon composition.

It is also an object of this invention to provide a process for durably improving the hydrophilic properties of a fibrous substrate comprising a hydrophobic fiber.

It is a further object of this invention to provide a process for durably improving the soil-release properties of a textile which comprises a hydrophobic fiber.

Another object of this invention is to provide fibrous substrates having durably affixed thereto a polyoxyethylene-containing siloxane polymer.

These and other objects, which will be obvious upon consideration of the following specification and appended claims, are obtained by (A) applying to a fibrous substrate a homogeneous liquid composition obtained by mixing components comprising (i) a volatile liquid carrier, (ii) a siloxane polymerization catalyst and (iii) a polyoxyethylene-containing silane having the formula $R(OCH_2CH_2)_xOR'SR''SiZ_3$ wherein R denotes a monovalent terminating radical selected from the group consisting of hydrogen, lower alkyl and lower acyl, R' and R'' each denote, independently a divalent aliphatic radical having from 1 to 6 carbon atoms, the total number of carbon atoms in R' and R'' intervening between Si and O being at least 3, each Z denotes a hydrolyzable radical or a hydroxyl radical and x has an average value of at least 3, and (B) heating the applied homogeneous liquid composition to remove any volatile liquid carrier therefrom and to cure the polyoxyethylene-containing silane.

The process of this invention provides, as an article of manufacture, a fibrous substrate having durably affixed thereto a polyoxyethylene-containing siloxane polymer having the unit formula $$R(OCH_2CH_2)_xOR'SR''SiZ_aO_{(3-a)/2}$$

wherein Z, R, R', R'' and x have the meanings listed above and a has an average value of less than 3.

Although this invention is not to be limited by theory, it is believed that the present invention provides a durable modification of the fibrous substrate because the known silanol-stabilizing action of the polyoxyethylene chain is sufficiently decreased in the silane (iii) so that curing, i.e. condensation, of the silanols to a siloxane structure, can occur during the heating step, thereby durably affixing the polyoxyethylene-containing siloxane polymer to the fibrous substrate.

DETAILED DESCRIPTION OF THE INVENTION

The process of this invention is operable for any fibrous substrate. By fibrous substrate it is meant any substrate comprising fibers, such as a bulk fiber, such as staple or a continuous filament; a plurality of fibers, such as a thread, a yarn, a roving or a rope; a fabric, such as a weave, a knit, a felt or a so-called non-woven; or a textile, such as flat goods, a garment or a garment part.

The fibers comprising the fibrous substrate may be of natural origin, such as cotton, wool, silk or fur; of regenerated origin, such as rayon and saponified cellulose acetate; of derived origin, such as cellulose acetate and cellulose triacetate; or of synthetic origin, such as polyamides, polyesters, polyurethanes, acrylics, modacrylics, polyvinyl halides, polyvinylidene halides and polyolefins.

The process of this invention provides hydrophilic properties and is most useful on fibrous substrates which comprise hydrophobic fibers. For example, fibrous substrates comprising a polyethylene terephthalate fiber, such as a 100% polyester textile or a textile which is a blend of a polyester fiber with other fibers such as cotton and/or wool and/or rayon, are particularly benefited by the process of this invention. Said fibrous substrates comprising a polyethylene terephthalate fiber are particularly plagued by the aforementioned, well-known soil-release problem during laundering; however, when treated by the process of this invention they are provided with improved hydrophilic character and soil-release properties as measured by the Water-Drop Holdout Test, the Water-Wicking Test and the Stain-Release Test, hereinafter noted.

The volatile liquid carrier (i) is preferably water, although any inert organic liquid which volatilizes readily below 200° C. may be used. Volatile liquid carrier (i) may consist of a single component or a mixture of components as desired.

Exemplary of organic liquids that may be used as the volatile liquid carrier (i) are hydrocarbons, such as toluene, xylene, cyclohexane, heptane, mineral spirits and naphtha; halohydrocarbons, such as methylene chloride and trichloroethane; and other commonly used liquids such as acetone, ethanol, isopropanol, tetrahydrofuran, dioxane, acetonitrile, dimethylformamide, dimethoxyethane and the dimethyl ether of diethylene glycol.

The siloxane polymerization catalyst (ii) may be any acidic or basic material which will cause the condensation of silanols to form a siloxane linkage. Suitable catalysts include HCl, $H_2SO_4$, $CCl_3COOH$, $H_3PO_4$, $CF_3SO_3H$, $CH_3COOH$, $Mg(OCOCH_3)_2$, $MgSO_4$, $Al(BF_4)_3$, $Mg(BF_4)_2$, $Zn(NO_3)_2$, $MgCl_2$, $Al_2Cl_x(OH)_{6-x}$, $ZnCl_2$, Zn(octoate)$_2$, $(C_4H_9)_4Sn(OCOCH_3)_2$, NaOH, KOH, $Ca(OH)_2$, $NH_3$, $Na_2SiO_3$, $NaOCOCH_3$, $\{(HOCH_2CH_2)_2NCH_2CH_2O\}_2Ti(Oi\text{-}Pr)_2$ and $Zn(OCOCH_3)_2$. Lewis acid catalysts are preferred as the siloxane polymerization catalyst because most commercial fabric treating processes are acidic processes.

The polyoxyethylene-containing silanes (iii) which are used to prepare the homogeneous liquid compositions that are used in the process of this invention are described generally by the formula $$R(OCH_2CH_2)_xOR'SR''SiZ_3. \quad (I)$$

Herein Z denotes a silicon-bonded hydroxyl radical or a silicon-bonded hydrolyzable radical which is convertible to a silicon-bonded hydroxyl radical by the action of water at room temperature. Hydrolyzable radicals (Z) include, but are not limited to, halogen, such as —Br and —Cl; alkoxy, such as $—OCH_3$, $—OCH_2CH_3$, $—OCH(CH_3)_2$ and $OC_4H_9$; alkoxyalkoxy, such as $—OCH_2CH_2OCH_3$, $—OCH_2CH_2OCH_2CH_2OCH_3$ and $—OCH_2CH_2OCH_2CH_3$; acyloxy, such as —OCOH, $—OCOCH_3$ and $—OCOCH_2CH_3$; and aryloxy, such as $OC_6H_5$. Conveniently, all hydrolyzable radicals in (I) are identical, although they need not be. In a preferred embodiment of this invention all Z radicals are $—OCH_3$ radicals.

In formula (I) R denotes a monovalent radical which serves to terminate the polyoxyethylene chain and is of such a nature that it does not completely negate the well-known hydrophilic contribution of the polyoxyethylene chain. Thus, R is selected from the group consisting of hydrogen; lower alkyl radicals having from 1 to 4 carbon atoms, such as methyl, ethyl, propyl, isopropyl and butyl; and lower acyl radicals having from 1 to 4 carbon atoms, such as formyl, acetyl, propionyl and butyryl. Of course silane (iii) may be a single compound having a single R radical or a mixture of two or more components having different R radicals, as desired.

In a preferred embodiment of this invention R is hydrogen, thereby providing a maximum contribution to the hydrophilic character of a fibrous substrate treated therewith.

R′ and R″ each denote a divalent aliphatic radical having from 1 to 6 carbon atoms, such as $—CH_2—$, $—CH_2CH_2$, $—CH_2CH_2CH_2—$, $—CH_2CH_2CH_2CH_2—$, $—CH_2CH(CH_3)CH_2—$ and $—(CH_2)_6—$. R′ and R″ may be different or identical, as desired.

The total number of carbon atoms in R′ and R″ which intervene between, i.e. space, the oxygen atom bonded to R′ and the silicon atom bonded to R″ is preferably small, but must be at least 3. For example, proper combinations of R′ and R″ include $—CH_2—/—CH_2CH_2—$, $—CH_2CH_2—/—CH_2—$, $—CH_2CH_2—/—CH_2CH_2—$, $$—CH_2—/—CH_2CH_2\overset{|}{C}HCH_3$$

and the like, but do not include $—CH_2—/—CH_2—$ and $$CH_3\overset{|}{C}—/—CH_2— .$$

That is to say, a fibrous substrate prepared by the process of this invention is expected to have better hydrophilicity when the total number of atoms in R′ and R″ is small; however, the durability of the treatment is favored by the presence of more than two intervening carbon atoms in R′ and R″. Silanes of formula (I) are conveniently synthesized, and a good balance between hydrophilicity and durability for the fibrous substrate treatment are obtained, when R′ and R″ are each $—CH_2CH_2CH_2—$.

To provide improved hydrophilic properties for a fibrous substrate which has been treated by the process of this invention, x, in formula (I), must have an average value of at least 3, preferably at least 7, and most preferably at least 12. The exact value of x that is needed to provide a desired improvement in said hydrophilic properties will vary directly with the size of the R, R′ and R″ radicals that are present in the silane (iii). There is no known upper limit for the value of x, but practical considerations, such as the resulting usable viscosity of the silane or of a homogeneous liquid composition obtained therefrom, indicate that an upper limit of approximately 100, preferably 30, is preferred.

A preferred polyoxyethylene-containing silane (iii) to be used in the process of this invention has the formula $H(OCH_2CH_2)_xO(CH_2)_3S(CH_2)_3Si(OCH_3)_3$ wherein x has an average value of approximately 12. Such a silane provides a durable surface having excellent hydrophilicity and stain-releasability when applied to a fibrous substrate comprising a hydrophobic fiber.

It is to be understood that the values for x stated herein are average values and may represent a single molecular species or a mixture of two or more molecular species.

The polyoxyethylene-containing silane (iii) may be prepared by known methods. For example, an equimolar mixture of $R(OCH_2CH_2)_xOCH_2CH{=}CH_2$ and $HSCH_2CH_2CH_2Si(OCH_3)_3$ may be subjected to free-radical generating conditions to effect addition of the sulfhydryl group to the aliphatic unsaturation. This reaction is illustrated for x=7.5 and $R=CH_3$ in U.S. Pat. No. 4,062,693.

While formula (I) denotes a silane, it is to be noted that the presence of three hydroxyl radicals and/or hydrolyzable radicals on the silicon atom thereof provides a ready means for the incidental formation of small amounts of siloxane linkages. It is therefore within the scope and spirit of this invention that the polyoxyethylene-containing silane (iii) which is mixed with the volatile liquid carrier may contain minor amounts of siloxane species of the general formula $R(OCH_2CH_2)_x$-

$OR'SR''SiZ_aO_{(3-a)/2}$ wherein a has an average value between 2 and 3 and trace amounts of said siloxane species wherein a has a value less than 2, as long as the liquid composition prepared therewith is homogeneous.

Furthermore, when R denotes hydrogen, silane (I) is capable of a condensation reaction between a hydrogen-endblocked polyoxyethylene chain and a silicon-bonded hydroxyl or hydrolyzable radical, thereby giving rise to cyclic and/or linear condensed species containing $—Si(OCH_2CH_2)_x—$ linkages. Since this reaction can be extensive it is within the scope and spirit of this invention that the polyoxyethylene-containing silane (iii) which is mixed with the volatile liquid carrier may contain various amounts, up to 100% of cyclic species of the formula $$\{—(OCH_2CH_2)_xOR'SR''\overset{|}{Si}Z_2\}_y$$

and/or linear species of the formulae $$H\{(OCH_2CH_2)_xOR'SR''\overset{|}{Si}Z_2\}_yZ$$

wherein y may have an average value of one or more. Of course, said cyclic and linear condensed species may also experience the incidental siloxane formation detailed above to give a complex mixture of molecular species in (iii).

Small amounts of said siloxanes noted above are permitted in the polyoxyethylene-containing silane (iii), and are within the scope and spirit of this invention because, in the process of this invention, silane (iii) is eventually hydrolyzed to silanol-containing species and condensed to a polysiloxane structure which is durably affixed to a fibrous substrate.

Various amounts of said cyclic and/or linear condensed species noted above are permitted in the polyoxyethylene-containing silane (iii), and are within the scope and spirit of this invention because, in the process of this invention, the $—Si(OCH_2CH_2)_x—$ linkages therein undergo hydrolysis to regenerate the hydrogen-terminated polyoxyethylene moiety.

In a preferred embodiment of this invention, wherein the volatile liquid carrier is water, said hydrolysis of SiZ linkages and $—Si(OCH_2CH_2)_x—$ linkages is thought to be extensive.

The relative amounts of volatile liquid carrier (i) and polyoxyethylene-containing silane (iii) that are mixed to form the homogeneous liquid compositions which are useful in the process of this invention are not critical and may vary widely, said amounts typically being established at a level that will readily provide the desired pick-up of silane by the fibrous substrate during one application of the homogeneous liquid composition. Preferably the homogeneous liquid composition is comprised of at least 10 percent by weight volatile liquid carrier.

For example, the amount of polyoxyethylene-containing silane (iii) in volatile liquid carrier (i) may conveniently be from 0.1 to 50 percent by weight, preferably from 0.1 to 5 weight percent, based on the total weight of (i) and (iii), when fabrics are treated in the conventional manner, although greater or lesser concentrations may obviously be used. In the newer, energy-saving techniques for treating textiles which comprises a foam-padding step the amount of polyoxyethylene-containing silane (iii) may account for as much as 90 percent by weight of (i) plus (iii).

The relative amount of catalyst (ii) that is used is typically that amount that will provide the desired rate of cure of the silane (iii) during the heating step of the process of this invention and is determined by routine experimentation.

The homogeneous liquid composition may comprise additional components, such as surfactants, exhaust agents and anti-foam agents, which are common to fiber-treating compositions. Herein "homogeneous" denotes a solution or a dispersion or an emulsion.

Although not required for homogenizing purposes, in many cases, a surfactant is nevertheless preferably incorporated in the homogeneous liquid compositions that are used in the process of this invention. The purpose of the surfactant in this case is to aid in the uniform deposition of the homogeneous liquid composition onto the fibrous substrate, thereby providing a more reproducible treatment of certain fibrous substrates.

Surfactants which are suitable for use in the homogeneous liquid compositions described herein may be non-ionic, anionic or cationic, as desired. Surfactants which are used in the process of this invention to provide a more uniform deposition of treatment onto a fibrous substrate must be experimentally identified for each combination of fibrous substrate and homogeneous liquid composition.

The homogeneous liquid composition is prepared by mixing its components in any suitable manner. For example, appropriate amounts of the polyoxyethylene-containing silane (iii), siloxane polymerization catalyst (ii) and volatile liquid carrier (i) may be mixed to form a homogeneous liquid composition which is ready for use in the method of this invention. Alternatively a premix, such as a concentrated version of the homogeneous liquid composition or a homogeneous liquid composition which is deficient in catalyst, may be prepared, stored and/or shipped and the required additional admixing, such as dilution with additional volatile liquid carrier or admixing of the catalyst accomplished at a latter time.

In a preferred embodiment of this invention a homogeneous liquid composition is prepared by dissolving $H(OCH_2CH_2)_{12}O(CH_2)_3S(CH_2)_3Si(OCH_3)_3$ in an equal weight of water and adjusting the pH of the resulting concentrated solution to a value of less than 7.0. The resulting concentrated solution is thereafter diluted with additional water to the desired concentration and a non-ionic surfactant and a Lewis acid added thereto.

The homogeneous liquid composition may be applied to the fibrous substrate by any suitable method, such as by spraying, padding, dipping and foaming.

After application of the homogeneous liquid composition to the fibrous substrate, the treated substrate is heated to remove any volatile liquid carrier and to cure the polyoxyethylene-containing silane. The temperature and time parameters which are used during this heating step are not critical and are conventionally related, i.e. lower temperatures require longer heating times to achieve a desired level of cure. Temperatures which degrade the substrate or the siloxane polymer should be avoided. A preferred heating process for treated polyethylene terephthalate fibers uses 180° to 200° C. for 15 seconds to 2 minutes. Some nylons require lower temperatures.

The process of this invention, regardless of whether or not the volatile liquid carrier that is used is water, provides as an article of manufacture, a fibrous substrate having durably affixed to the surface thereof a polyoxyethylene-containing siloxane polymer having the unit formula $R(OCH_2CH_2)_xOR'SR''SiZ_aO_{(3-a)/2}$ wherein a has an average value of less than three and the other symbols therein are either conventional or have been previously identified. The indicated siloxane structure may be partially formed during preparation and/or application of the homogeneous liquid composition via hydrolysis of hydrolyzable groups in the silane by water and condensation of the resulting silanols. The necessary hydrolysis water may come from the volatile liquid carrier and/or the atmosphere and/or the surface of the fibrous substrate. The siloxane structure is thereafter developed on the fibrous substrate during the heating step. It is to be understood that the hydrolysis and condensation of the polyoxyethylene-containing silane need not be complete, although this may be the case, in order for the silane to be durably affixed to the fibrous substrate. That is to say, a may have any value less than three, such as 0, 0.1, 0.5, 0.8, 1.0, 1.5, 2.0 etc.

The following examples are disclosed to further illustrate, but not to limit, this invention. In these examples hydrophilicity of a fibrous substrate was evaluated by the Water Drop Holdout Test and/or the Water-Wicking Test. Soil-release of a fibrous substrate was evaluated by the Stain Release Test.

Water-Drop Holdout Test—AATCC Test Method 39-1974. A drop of water is syringed directly onto a fabric sample which has been laid flat on a non-absorbent surface and the length of time for the drop to be absorbed by the fabric is recorded. The test discontinued after 60 seconds.

Water-Wicking Test—A strip of fabric, ¾"×4", with a 3-centimeter long section marked-off in the middle of the sample is weighted on the bottom edge with a paper clip and immersed in water to the lower mark of the 3 cm. zone. The time required for the water to wick to the upper mark of the 3 cm. zone is recorded, if less than 180 seconds. If the water does not wick 3 cm. in 180 seconds the distance wicked in 180 seconds is recorded.

Stain Release Test—This test is a modified AATCC Test Method 130-1974. It differs from the AATCC Test Method 130-1974 in two respects. Whereas the AATCC test uses only mineral oil for staining, the modified AATCC test uses several staining materials, including mineral oil. Also, whereas the AATCC test directs that the stained samples must be laundered within 15 to 60 minutes after staining the modified AATCC test delays laundering for 18 hours. In each case the stain release of the laundered samples is rated from 1 (poor) to 5 (excellent) by comparison with standard replicas.

All samples of polyester fabric were scoured according to AATCC Test Method 135-1973, Condition III, before being treated by the process of this invention. Laundering of treated samples and stained samples, to determine soil-release and durability of treatment, was conducted under Condition II of AATCC Test Method 135-1973.

All parts and percentages are by weight.

EXAMPLE 1

This example demonstrates the improved hydrophilicity of a polyester knit treated by the process of this invention and the durability thereof to laundering.

A homogeneous liquid composition was prepared by first mixing 46.88 parts of $H(OCH_2CH_2)_{12}O(CH_2)_3S(CH_2)_3\text{-}Si(OCH_3)_3$, 46.87 parts of water and 6.25 parts of octylphenoxypolyethoxy(40)ethanol (Triton X-405), and then mixing 3.5 parts of the resulting solution with 98.15 parts of water and 0.73 parts of triethanolamine titanate. The resulting homogeneous liquid composition consisted of 1.64 percent silane, 0.22 percent surfactant, 0.73 percent catalyst and 97.41 percent volatile liquid carrier.

Two 12 in.×12 in. pieces of scoured 100 percent polyester double knit fabric were padded with the above homogeneous liquid composition and nipped to 225 percent wet pick-up, based on the weight of the fabric.

The nipped fabrics were heated at 100° C. for 25 minutes to dry the fabrics and at 150° C. for 5 minutes to cure the polyoxyethylene-containing silane. The treated fabrics were then weighed to determine the intermediate amount of add-on (4.40 percent, based on the weight of the fabric and corrected for the weight loss experienced by a control fabric). The fabrics were then given an initial wash and tumbled dry according to AATCC Test Method 135-1973, Condition II, and weighed to determine the final add-on of siloxane (0.65 percent, corrected as above). A control fabric was treated identically, except only water was used, and was found to have an intermediate add-on of −0.15 percent (a weight loss) and a final add-on of −0.3 percent.

The control fabric and the fabrics treated by the method of this invention were evaluated for hydrophilicity by the above-described Water Drop Holdout Test and the Water-Wicking Test, initially and after 12 washes. Results are summarized in Table I.

Table I

| Test | No. of Launderings | Test Time (seconds) Treated | Control |
|---|---|---|---|
| Water-Drop | 0 | <1 | >60 |
| | 12 | 1 | >60 |
| Water-Wicking | 0 | 7/3 cm. | >180/0 cm. |
| | 12 | 14/3 cm. | >180/0 cm. |

EXAMPLE 2

The control fabric and the treated fabrics of Example 1 were stained with Nujol brand mineral oil, Wesson brand cooking oil, French's brand yellow mustard, butter and used, heavy duty gear lubricating oil and thereafter washed and rated a number of times according to the modified AATCC Test Method 130-1974, noted above.

Samples were restrained after the 5th and 10th wash. Table II, which summarizes the stain release results, shows the durably improved oily-stain release that is afforded a fibrous substrate that has been treated by the process of this invention. A rating of at least 4 after two washes is considered acceptable stain release.

Table II

| Stain | No. of Launderings | Stain Release Rating Treated | Control |
|---|---|---|---|
| Mineral Oil | 1 | 4 | 3.5 |
| | 2 | 5 | 4 |
| | 6 | 5 | 3 |
| | 7 | 5 | 3 |
| | 11 | 5 | 3.5 |
| | 12 | 5 | 4.5 |
| Cooking Oil | 1 | 4.5 | 3 |

Table II-continued

| Stain | No. of Launderings | Stain Release Rating Treated | Control |
|---|---|---|---|
| | 2 | 5 | 3 |
| | 6 | 5 | 3.5 |
| | 7 | 5 | 3 |
| | 11 | 4 | 3.5 |
| | 12 | 4 | 4.5 |
| Mustard | 1 | 3 | 5 |
| | 2 | 3.5 | 5 |
| | 6 | 2 | 5 |
| | 7 | 3 | 5 |
| | 11 | 3 | 4.5 |
| | 12 | 3 | 5 |
| Butter | 1 | 5 | 3.5 |
| | 2 | 5 | 4 |
| | 6 | 4 | 4 |
| | 7 | 4 | 4 |
| | 11 | 4.5 | 4 |
| | 12 | 4.5 | 5 |
| Gear Oil | 1 | 5 | 2 |
| | 2 | 5 | 2 |
| | 6 | 5 | 3 |
| | 7 | 5 | 3 |
| | 11 | 4 | 3 |
| | 12 | 4.5 | 3 |

EXAMPLE 3

This example demonstrates the superior durability to commercial laundering that is afforded to a polyester knit by the process of this invention.

A homogeneous liquid composition was prepared by mixing 1.6 parts of the solution of silane, water and surfactant described in Example 1, 0.25 parts of triethanolamine titanate and 98.15 parts of water.

Two 12 in.×12 in. samples of 100% polyester double knit fabric were treated as in Example 1 except that the cure temperature was 160° C. The fabrics (Treated #1 and Treated #2) were nipped to 274 percent wet pick-up which resulted in an intermediate add-on of 2.39 and 2.31 percent, respectively, after curing, and a final add-on of 0.8 and 0.65 percent, respectively, after an initial wash and tumble dry. A control sample exhibited a final add-on of −0.2 percent. In addition, a fabric sample bearing a Zelcon® TGF (E. I. DuPont de Nemours) finish was also prepared. This sample had a wet pick-up of 257 percent, an intermediate add-on of 4.5 percent and a final add-on of 0.39 percent and was cured at 183° C. for 1 minute as recommended by the manufacturer.

All four samples were tested for hydrophilicity using the Water-Drop Holdout Test and the Water-Wicking Test. The samples were then subjected to 5 commercial launderings using 170°–175° F. wash water, Clarix Soap (BASF Wyandotte), an acid fluoride salt rinse, a chlorine bleach and a cationic organic softener. One AATCC 135-1973 (Condition II) wash and tumble dry was used to remove the organic softener before the hydrophilicity evaluations were repeated. Results are summarized in Table III.

Table III

| Test | Commercial Launderings | Test Time (seconds) Treated #1 | Treated #2 | Control | Zelcon® IGF |
|---|---|---|---|---|---|
| Water Drop | 0 | <1 | <1 | >60 | <1 |
| | 5 | 1 | 1 | >60 | 40 |
| Water Wicking | 0 | 10/3 cm. | 7/3 cm. | 180/0 cm. | 12.3 cm. |

Table III-continued

| Test | Commercial Launderings | Test Time (seconds) Treated #1 | Treated #2 | Control | Zelcon® IGF |
|---|---|---|---|---|---|
| | 5 | 130/3 cm. | 85/3 cm. | 180/0 cm. | 180/2 cm |

EXAMPLE 4

The four fabrics of Example 3 were stained with Nujol brand mineral oil, Wesson brand cooking oil, French's brand yellow mustard, butter and heavy-duty gear lubricating oil after the 5 commercial launderings and were thereafter laundered according to AATCC 135-173, Condition II, and rated twice according to the Stain Release Test. Table IV summarizes the results.

Table IV

| Stain | Number of Launderings Afte- Five Commercial Launderings | Stain Release Rating Treated #1 | Treated #2 | Control | Zelcon® TGF |
|---|---|---|---|---|---|
| Mineral Oil | 1 | 4 | 4 | 3 | 4 |
| | 2 | 5 | 4 | 4 | 4 |
| Cooking Oil | 1 | 4.5 | 4 | 3 | 4 |
| | 2 | 5 | 4 | 3 | 4 |
| Mustard | 1 | 4.5 | 5 | 4.5 | 5 |
| | 2 | 4.5 | 5 | 5 | 5 |
| Butter | 1 | 4 | 4 | 3.5 | 4 |
| | 2 | 5 | 4 | 3 | 4 |
| Gear Oil | 1 | 4.5 | 4 | 1 | 3.5 |
| | 2 | 5 | 4.5 | 3 | 4.5 |

EXAMPLE 5

Two homogeneous liquid compositions were prepared by first mixing 50.00 parts of $H(CH_2CH_2)_{12}O(CH_2)_3S(CH_2)_3$— $Si(OCH_3)_3$, 49.55 parts of water and 0.05 parts of glacial acetic acid to provide solutions having a pH of 6, and then mixing 1.5 parts of the resulting solutions with 98.15 parts of water, 0.25 parts of magnesium acetate and 0.1 parts of either Triton X-405 brand octylphenoxypolyethoxy(40)ethanol (Composition A—used in Examples 5, 6, 7 and 8) or FC-134 brand fluoroalkylquaternary ammonium iodide (Composition B—used in Examples 7 and 8). Each composition consisted of 0.75 percent silane, 0.1 percent surfactant, 98.90 percent volatile liquid carrier and 0.25 percent catalyst (magnesium acetate+acetic acid).

Two 12 in.×12 in. pieces of 100% polyester double knit fabric (7.1 ounces/square yard) were scoured and were then padded with Composition A and were nipped to 244 percent wet pick-up. The nipped fabrics were heated at 100° C. for 25 minutes for drying and at 180° C. for 75 seconds for curing of the polyoxyethylene-containing silane. Sample weighings revealed an intermediate add-on of 2.78 percent. After an initial wash and tumble dry according to AATCC Test Method 135–1973, weighing of the treated fabric revealed a final add-on of 0.78 percent. A control sample was identically prepared except that water was used instead of the homogeneous liquid composition and a final add-on of −0.4 percent was recorded.

The control sample had a water-drop holdout time of greater than 60 seconds and did not show any water-wicking in 180 seconds, thus demonstrating its hydrophobicity. The samples treated by the process of this invention had a water-drop holdout time of less than 1 second and a water-wicking time of 17 seconds for 3 cm., thus demonstrating their hydrophilicity.

EXAMPLE 6

The treated fabrics and the control fabric of Example 5 were stained as in Example 2, except that used motor oil was used instead of the gear oil, and were evaluated for stain release after the 1st, 2nd, 11th and 12th wash. Samples were restained after the 5th and 10th wash. The ratings, which are listed in Table V, demonstrate the durability and oily-stain releasability of a fabric treatment provided by the process of this invention.

Table V

| Stain | No. of Launderings | Stain Release Rating Treated A | Control |
|---|---|---|---|
| Used Motor Oil | 1 | 4 | 2 |
| | 2 | 5 | 3 |
| | 11 | 5 | 3 |
| | 12 | 5 | 3 |
| Mineral Oil | 1 | 4.5 | 3 |
| | 2 | 5 | 4 |
| | 11 | 4.5 | 3 |
| | 12 | 4 | 3 |
| Cooking Oil | 1 | 4.5 | 3 |
| | 2 | 5 | 3 |
| | 11 | 5 | 2 |
| | 12 | 5 | 2 |
| Mustard | 1 | 3 | 4.5 |
| | 2 | 4 | 4.5 |
| | 11 | 3.5 | 5 |
| | 12 | 4 | 5 |
| Butter | 1 | 4.5 | 3 |
| | 2 | 5 | 3.5 |
| | 11 | 5 | 2 |
| | 12 | 5 | 2 |

EXAMPLE 7

This example demonstrates the treating of a polyester weave.

The two homogeneous liquid compositions of Example 5 were used to treat two samples of a 100 percent polyester weave (77×60 yarns/inch, 3.1 ounces/square yard) using the process of this invention as described in Example 5. The sample (Treated A) that was treated with the octylphenoxypolyethoxy(40)ethanol-containing composition (Composition A) had a wet pick-up of 103 percent, an intermediate add-on of 1.1 percent and a final add-on of 0.38 percent. The sample (Treated B) that was treated with the fluoroalkylquaternary ammonium iodide-containing composition (Composition B) had a wet pick-up of 61 percent, an intermediate add-on of 1.03 percent and a final add-on of 0.4 percent. A control, treated identically, but only with water, had a wet pick-up of 107 percent, an intermediate add-on of −0.07 percent and a final add-on of −0.11 percent.

The two treated samples and the control were evaluated, initially and after 5 and 10 washes, for hydrophilicity using the Water-Drop Holdout Test and the Water-Wicking Test. The results, summarized in Table VI, show the efficacy and the durability of the hydrophilic properties that are provided for a fibrous substrate by the process of this invention.

Comparison of the initial hydrophilicity of the Treated A woven fabrics of this example and of the treated double knit fabrics of Example 5 also show that the initial water-wicking behavior (17 seconds/3 cm. vs. 70 seconds/3 cm.) of a treated fabric can vary with the fabric construction.

Table VI

| Test | No. of Launderings | Test Time (seconds) Treated A | Treated B | Control |
|---|---|---|---|---|
| Water-Drop | 0 | 1 | 1 | >60 |
| | 5 | 15 | 22 | >60 |
| | 10 | 15 | 15 | >60 |
| Water-Wicking | 0 | 70/3 cm. | 60/3 cm. | 135/3 cm. |
| | 5 | 85/3 cm. | 70/3 cm. | 155/3 cm. |
| | 10 | 77/3 cm. | 80/3 cm. | 135/3 cm. |

EXAMPLE 8

The two treated samples and the control sample of Example 7 were stained as in Example 6 and were evaluated for stain release after the first and second wash. The ratings, which are listed in Table VII, demonstrate the stain-releasability during laundering of a fabric treated by the process of this invention.

Table VII

| Stain | No. of Launderings | Stain Release Rating Treated A | Treated B | Control |
|---|---|---|---|---|
| Used Motor Oil | 1 | 3 | 3 | 1 |
| | 2 | 4 | 4 | 2 |
| Mineral Oil | 1 | 3 | 3 | 1 |
| | 2 | 4 | 4 | 3 |
| Cooking Oil | 1 | 3 | 3 | 1 |
| | 2 | 4 | 4 | 3 |
| Mustard | 1 | 4 | 4 | 4 |
| | 2 | 5 | 5 | 5 |
| Butter | 1 | 3 | 3 | 1 |
| | 2 | 4 | 4 | 3 |

EXAMPLE 9

A premix was prepared by dissolving $H(OCH_2CH_2)_{12}O\text{-}(CH_2)_3S(CH_2)_3Si(OCH_3)_3$ in an equal weight of water and adjusting the pH of the solution to 6 with glacial acetic acid. A homogeneous liquid composition was prepared by mixing 3.7 parts of the premix and 0.6 parts of magnesium acetate with 95.7 parts of water and consisted of 1.85 percent silane, 97.55 percent volatile liquid carrier and 0.6 percent catalyst. A polyester weave was treated with the above homogeneous liquid composition as in Example 5, resulting in a wet pick-up of 117 percent, an intermediate add-on of 2.87 percent and a final add-on of 1.11 percent. The treated sample had a water-drop holdout time of 60 seconds and a water-wicking distance of 2.5 cm. for 180 seconds. A control sample had a water-drop holdout time of greater than 60 seconds and a water-wicking distance of 0 cm. for 180 seconds. This example demonstrates the process of this invention wherein a surfactant is not used to aid in the application of the homogeneous liquid composition to the fibrous substrate. Improved hydrophilicity of the fibrous substrate was obtained but better results can be obtained if a surfactant is used, as recorded in the preceding examples.

EXAMPLE 10

This example demonstrates the process of this invention using a basic siloxane polymerization catalyst.

A homogeneous liquid composition was prepared by mixing 1.5 parts of the premix of Example 9, 0.25 parts of sodium silicate, 0.1 parts of octylphenoxypolyethoxy(40)-ethanol and 98.15 parts of water and the resulting solution was used to treat a polyester weave as in Example 5. The fabric experienced a wet pick-up of 130 percent, an intermediate add-on of 1.29 percent and a final add-on of 1.0 percent. The treated fabric had a water-drop holdout time of less than one second and a 3 cm. water-wicking time of 68 seconds.

EXAMPLE 11

This example demonstrates the treating of a polyester-wool blend to improve hydrophilicity.

A homogeneous liquid composition was prepared by mixing 1.5 parts of the premix of Example 9, 0.25 parts of magnesium acetate, 0.1 parts of octylphenoxypolyethoxy(40)-ethanol and 98.15 parts of water. A polyester-wool blend was treated with the resulting solution so that the fabric experienced a wet pick-up of 124 percent, an intermediate add-on of 1.2 percent and a final add-on of 0.38 percent. The silane was heated at 170° C. for 75 seconds to effect curing. Whereas a control fabric had a wicking distance of 2.5 cm. in 180 seconds, the treated fabric had a wicking time of 150 seconds for 3 cm.

EXAMPLE 12

This example demonstrates the use of $$CH_3\overset{\overset{\displaystyle O}{\|}}{C}(OCH_2CH_2)_{12}O(CH_2)_3S(CH_2)_3Si(OCH_3)_3$$

as a modifying silane.

A premix was prepared by mixing the above silane with an equal weight of water and acidifying the resulting mixture to a pH of 6 with glacial acetic acid. A homogeneous liquid composition was prepared by mixing 1.2 parts of the premix with 0.25 parts of magnesium acetate, 0.1 parts of octylphenoxypolyethoxy(40)ethanol and 98.45 parts of water. A second homogeneous liquid composition was identically prepared except that 0.25 parts of sodium silicate was used instead of the magnesium acetate.

Samples of a polyester weave were treated with the above homogeneous liquid compositions as in Example 5.

The fabric that was treated with the magnesium acetate-containing composition (Treated I) had a wet pick-up of 125 percent, an intermediate add-on of 0.92 percent and a final add-on of 0.12 percent. The fabric that was treated with the sodium silicate-containing composition (Treated II) had a wet pick-up of 137 percent, an intermediate add-on of 1.24 percent and a final add-on of 0.65 percent. The treated fabrics were evaluated for hydrophilic behavior and compared to a control sample using the Water-Drop Test and the Water-Wicking Test. Data are summarized in Table VIII.

Table VIII

| | Test Time (seconds) | | |
|---|---|---|---|
| Test | Treated I | Treated II | Control |
| Water Drop | 38 | 1 | >60 |
| Water-Wicking | 147/3 cm. | 59/3 cm. | 180/2.5 cm. |

That which is claimed is:

1. A process for durably modifying a fibrous substrate with a polyoxyethylene-containing silane, said process comprising (A) applying to the fibrous substrate a homogeneous liquid composition obtained by mixing components comprising (i) a volatile liquid carrier, (ii) a siloxane polymerization catalyst and (iii) a polyoxyethylene-containing silane having the formula $$R(OCH_2CH_2)_xOR'SR''SiZ_3$$

wherein R denotes a monovalent terminating radical selected from the group consisting of hydrogen, lower alkyl and lower acyl, R' and R'' each denote, independently, a divalent aliphatic radical having from 1 to 6 carbon atoms, the total number of carbon atoms in R' and R'' intervening between Si and O being at least 3, each Z denotes a hydrolyzable radical or a hydroxyl radical and x has an average value of at least 3, and (B) heating the applied homogeneous liquid composition to remove any volatile liquid carrier therefrom and to cure the polyoxyethylene-containing silane.

2. A process according to claim 1 wherein the volatile liquid carrier comprises water.

3. A process according to claim 2 wherein the homogeneous liquid composition is an aqueous solution and the polyoxyethylene-containing silane has the formula $H(OCH_2CH_2)_xO(CH_2)_3S(CH_2)_3Si(OCH_3)_3$ wherein x has an average value of approximately 12.

4. A process according to claims 2 or 3 wherein the homogeneous liquid composition further comprises a surfactant.

5. A process according to claim 4 wherein the fibrous substrate comprises a polyethylene terephthalate fiber.

6. As an article of manufacture a fibrous substrate having durably affixed thereto a polyoxyethylene-containing siloxane polymer having the unit formula $$R(OCH_2CH_2)_xOR'SR''\underset{\underset{\displaystyle Z_a}{|}}{SiO}_{(3-a)/2}$$

wherein R denotes a monovalent terminating radical selected from the group consisting of hydrogen, lower alkyl and lower acyl, R' and R'' each denote, independently, a divalent aliphatic radical having from 1 to 6 carbon atoms, the total number of carbon atoms in R' and R'' intervening between Si and O being at least 3, each Z denotes a hydrolyzable radical or a hydroxyl radical, x has an average value of at least 3 and a has an average value of less than 3.

7. The article of claim 6 wherein the polyoxyethylene-containing siloxane polymer has the unit formula $$H(OCH_2CH_2)_xO(CH_2)_3S(CH_2)_3\overset{\overset{\displaystyle (OH)_n}{|}}{\underset{\underset{\displaystyle (OCH_3)_n}{|}}{Si}}O_{(3-n-m)/2}$$

wherein x has an average value of approximately 12 and the n, m and n+m each have an average value of from 0 to less than 3.

8. The article of claim 7 wherein the fibrous substrate comprises a polyethylene terephthalate fiber.

* * * * *

UNITED STATES PATENT AND TRADEMARK OFFICE

CERTIFICATE OF CORRECTION

PATENT NO. : 4,207,071

DATED : June 10, 1980

INVENTOR(S) : Jonathan Lipowitz & Robert E. Kalinowski

It is certified that error appears in the above-identified patent and that said Letters Patent are hereby corrected as shown below:

In Column 8, line 3; the formula reading "$_{12}O(CH_2)_3S(CH_2)_3-Si(OCH_3)_3$," should read "$_{12}O(CH_2)_3S(CH_2)_3Si(OCH_3)_3$,".

In Column 8, line 68; the category under the subheading reading "Cooking OIl" should read "Cooking Oil".

In Column 9, line 63; the subheading reading "Zelcon® IGF" should read "Zelcon® TGF".

In Column 9, line 67; the number reading "12.3 cm." should read "12/3 cm.".

In Column 10, line 5; the subheading reading "Zelcon® IGF" should read "Zelcon® TGF".

In Column 10, line 6; the number reading "180/2 cm" should read "180/2 cm.".

UNITED STATES PATENT AND TRADEMARK OFFICE

CERTIFICATE OF CORRECTION

PATENT NO. : 4,207,071

DATED : June 10, 1980

INVENTOR(S) : Jonathan Lipowitz & Robert E. Kalinowski

It is certified that error appears in the above-identified patent and that said Letters Patent are hereby corrected as shown below:

In Column 10, line 22; the word in the second subheading reading "Afte-" should read "After".

In Column 12, line 39; the formula reading "$_{12}O-(CH_2)_3S(CH_2)_3Si(OCH_3)_3$" should read "$_{12}O(CH_2)_3S(CH_2)_3Si(OCH_3)_3$".

In Column 12, line 68; the word reading "y(40)-ethanol" should read "y(40)ethanol".

In Column 13, line 14; the word reading "thoxy(40)-ethanol" should read "thoxy(40)ethanol".

Signed and Sealed this

*Twenty-ninth* Day of *September 1981*

[SEAL]

*Attest:*

GERALD J. MOSSINGHOFF

*Attesting Officer*

*Commissioner of Patents and Trademarks*